US010895845B2

(12) United States Patent
Di Domenico et al.

(10) Patent No.: US 10,895,845 B2
(45) Date of Patent: Jan. 19, 2021

(54) TIMEPIECE OSCILLATOR WITH FLEXURE BEARINGS HAVING A LONG ANGULAR STROKE

(71) Applicant: The Swatch Group Research and Development Ltd, Marin (CH)

(72) Inventors: Gianni Di Domenico, Neuchatel (CH); Pierre Cusin, Villars-Burquin (CH); Jean-Luc Helfer, Le Landeron (CH); Alex Gandelhman, Neuchatel (CH); Pascal Winkler, St-Blaise (CH); Baptiste Hinaux, Lausanne (CH); Dominique Lechot, Les Reussilles (CH); Olivier Matthey, Grandson (CH); Laurent Klinger, Bienne (CH); Jerome Favre, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 16/439,798

(22) Filed: Jun. 13, 2019

(65) Prior Publication Data

US 2019/0391532 A1 Dec. 26, 2019

(30) Foreign Application Priority Data

Jun. 25, 2018 (EP) ..... 18179623
Jul. 24, 2018 (EP) ..... 18185137

(51) Int. Cl.
*G04B 17/30* (2006.01)
*G04B 31/00* (2006.01)
*G04B 15/14* (2006.01)

(52) U.S. Cl.
CPC ..... *G04B 17/30* (2013.01); *G04B 15/14* (2013.01); *G04B 31/00* (2013.01)

(58) Field of Classification Search
CPC ..... G04B 17/04; G04B 17/045; G04B 17/28; G04B 17/30; G04B 15/14; G04B 31/00;
(Continued)

(56) References Cited

U.S. PATENT DOCUMENTS 3,269,106 A * 8/1966 Waldburger ..... G04C 3/102 368/168
3,528,308 A * 9/1970 Favre ..... G04B 17/04 74/142

(Continued)

FOREIGN PATENT DOCUMENTS

CH 709 536 A2 10/2015
CH 713 151 A2 5/2018

(Continued)

OTHER PUBLICATIONS

European Search Report dated Jan. 25, 2019 in European Application 18185137.9, filed on Jul. 24, 2018 (with English Translation of Categories of Cited Documents).

(Continued)

*Primary Examiner* — Edwin A. Leon
(74) *Attorney, Agent, or Firm* — Oblon, McClelland, Maier & Neustadt, L.L.P.

(57) ABSTRACT

A mechanical timepiece oscillator including, between a first element and a second inertial element, more than two distinct flexible strips returning the inertial element to a rest position in an oscillation plane, wherein the projections of these strips cross each other, at a point, through which passes the axis of pivoting of the second solid inertial element, and the height to thickness aspect ratio is less than 10 for each strip.

20 Claims, 5 Drawing Sheets

(58) Field of Classification Search
CPC ..... G04B 17/10; G04B 13/026; G04B 17/32; G04B 31/004; G04B 17/26; G04B 31/02; G04C 3/102; G04C 3/008; G04C 3/101
USPC ..... 368/169
See application file for complete search history.

(56) References Cited

U.S. PATENT DOCUMENTS

| | | | | |
|---|---|---|---|---|
| 3,628,781 | A | 12/1971 | Grib | |
| 9,134,705 | B2 * | 9/2015 | Vardi | G04B 15/08 |
| 9,477,205 | B2 * | 10/2016 | Born | G04B 17/04 |
| 2015/0234354 | A1 | 8/2015 | Henein et al. | |
| 2015/0248112 | A1 * | 9/2015 | Stranczl | G04B 15/08 368/132 |
| 2018/0143591 | A1 | 5/2018 | Di Domenico et al. | |

FOREIGN PATENT DOCUMENTS

| | | | |
|---|---|---|---|
| EP | 2 911 012 | A1 | 8/2015 |
| EP | 2 998 800 | A2 | 3/2016 |
| EP | 2 998 800 | B1 | 3/2016 |
| EP | 3 035 127 | A1 | 6/2016 |
| EP | 3 130 966 | A1 | 2/2017 |
| EP | 3 326 963 | A1 | 5/2018 |
| EP | 3 382 470 | A1 | 10/2018 |
| WO | WO 2017/055983 | A1 | 4/2017 |

OTHER PUBLICATIONS

European Search Report dated Jan. 2, 2019 in European Application 18179623.6, filed on Jun. 25, 2018 (with English Translation of Categories of Cited Documents).

M.H. Kahrobaiyan, et al. "Gravity insensitive flexure pivots for watch oscillators", International Conference on Chronometry, Sep. 28-29, 2016, 7 pages.

Japanese Office Action dated Jul. 7, 2020 in Patent Application No. 2019-114362 (with English translation), 6 pages.

Office Action dated Sep. 16, 2020 in China Patent Application No. 201910550073.0 (with English translation); 13 pgs.

* cited by examiner

TIMEPIECE OSCILLATOR WITH FLEXURE BEARINGS HAVING A LONG ANGULAR STROKE

CROSS-REFERENCE TO RELATED APPLICATIONS

This application claims priority to European Patent Application Nos. 18179623.6 filed on Jun. 25, 2018 and 18185137.9 filed on Jul. 24, 2018, the entire disclosures of which is hereby incorporated herein by reference.

FIELD OF THE INVENTION

The invention concerns a mechanical timepiece oscillator comprising a first rigid support element, a second solid inertial element and, between said first rigid support element and said second solid inertial element, at least two first flexible strips which support said second solid inertial element and are arranged to return it to a rest position, wherein said second solid inertial element is arranged to oscillate angularly in an oscillation plane about said rest position, said two first flexible strips do not touch each other and their projections onto the oscillation plane intersect, in the rest position, at a crossing point, in immediately proximity to which or through which passes the axis of rotation of said second solid inertial element perpendicularly to said oscillation plane, and the embedding points of said first flexible strips in said first rigid support element and said second solid inertial element define two strip directions which are parallel to said oscillation plane.

The invention also concerns a timepiece movement including at least one such mechanical oscillator.

The invention also concerns a watch including such a timepiece movement.

The invention concerns the field of mechanical oscillators for timepieces comprising flexure bearings with flexible strips performing the functions of holding and returning movable elements.

BACKGROUND OF THE INVENTION

The use of flexure bearings, particularly having flexible strips, in mechanical timepiece oscillators, is made possible by processes, such as MEMS, LIGA or similar, for developing micromachinable materials, such as silicon and silicon oxides, which allow for very reproducible fabrication of components which have constant elastic characteristics over time and high insensitivity to external agents such as temperature and moisture. Flexure pivots, such as those disclosed in European Patent Applications EP1419039 or EP16155039 by the same Applicant, can, in particular, replace a conventional balance pivot, and the balance spring usually associated therewith. Removing pivot friction also substantially increases the quality factor of an oscillator. However, flexure pivots generally have a limited angular stroke, of around 10° to 20°, which is very low in comparison to the usual 300° amplitude of a balance/balance spring, and which means they cannot be directly combined with conventional escapement mechanisms, and especially with the usual stopping members such as a Swiss lever or suchlike, which require a large angular stroke to ensure proper operation.

At the International Chronometry Congress in Montreux, Switzerland, on 28 and 29 Sep. 2016, the team of M. H. Kahrobaiyan first addressed the increase in this angular stroke in the article 'Gravity insensitive flexure pivots for watch oscillators', and it appears that the complex solution envisaged is not isochronous.

EP Patent Application No 3035127A1 in the name of the same Applicant, SWATCH GROUP RESEARCH & DEVELOPMENT Ltd discloses a timepiece oscillator comprising a time base with at least one resonator formed by a tuning fork, which includes at least two oscillating moving parts, wherein said moving parts are fixed to a connection element, comprised in said oscillator, by flexible elements whose geometry determines a virtual pivot axis having a determined position with respect to said connection element, said respective moving part oscillates about said virtual pivot axis and the centre of mass of said moving part coincides in the rest position with said respective virtual pivot axis. For at least one said moving part, said flexible elements are formed of crossed elastic strips extending at a distance from each other in two parallel planes, and whose directions, in projection onto one of said parallel planes, intersect at said virtual pivot axis of the moving part concerned.

U.S. Pat. No. 3,628,781A in the name of GRIB discloses a tuning fork, in the form a dual cantilever structure, for causing a pair of movable elements to have accentuated rotational motion, relative to a stationary reference plane comprising a first elastically deformable body having at least two similar elongated elastically bendable portions, the ends of each of said bendable portions being respectively integral with enlarged rigid portions of said element, the first of said rigid portions being fixed to define a reference plane and the second being elastically supported to have accentuated rotational motion relative to the first, a second elastically deformable body substantially identical to the first elastically deformable body, and means for rigidly securing the first of said respective rigid portions of said elastically deformable bodies in spaced relation to provide a tuning fork structure wherein each of the tines of the tuning fork comprises the free end of one of said elastically deformable bodies.

EP Patent Application No 2911012A1 in the name of CSEM discloses a rotary oscillator for timepieces comprising a support element intended to allow assembly of the oscillator in a timepiece, a balance, a plurality of flexible strips connecting the support element to the balance and capable of exerting a return torque on the balance, and a rim mounted integrally with the balance. The plurality of flexible strips comprises at least two flexible strips with a first strip disposed in a first plane perpendicular to the plane of the oscillator, and a second strip disposed in a second plane perpendicular to the plane of the oscillator and secant with the first plane. The first and second strips have an identical geometry and the geometric axis of oscillation of the oscillator is defined by the intersection of the first plane and the second plane, this geometric axis of oscillation crossing the first and second strips at ⅞ths of their respective length.

EP Patent Application No. 2998800A2 in the name of PATEK PHILIPPE discloses a timepiece component with a flexible pivot, including a first monolithic part defining a first rigid portion and a second rigid portion connected by at least a first elastic strip, and a second monolithic part defining a third rigid portion and a fourth rigid portion connected by at least a second elastic strip, wherein the first and second monolithic parts are assembled to each other such that the first and third rigid portions are integral with each other and the second and fourth rigid portions are integral with each other. The at least one first elastic strip and the at least one second elastic strip intersect contactlessly and define a virtual axis of rotation for the second and fourth rigid portions with respect to the first and third rigid portions. This component includes a bearing, integral with the second and fourth rigid portions and intended to guide rotation of an element moving about an axis distinct from the virtual axis of rotation and substantially parallel thereto.

European Patent Application No. EP3130966A1 in the name of ETA Manufacture Horlogère, Switzerland, discloses a mechanical timepiece movement which includes at least one barrel, a set of gear wheels driven at one end by the barrel, and an escapement mechanism of a local oscillator with a resonator in the form of a balance/balance spring and a feedback system for the timepiece movement. The escapement mechanism is driven at another end of the set of gear wheels. The feedback system includes at least one precise reference oscillator combined with a rate comparator to compare the rate of the two oscillators and a mechanism for regulating the local oscillator resonator to slow down or accelerate the resonator based on the result of a comparison in the rate comparator.

Swiss Patent Application No. CH709536A2 in the name of ETA SA Manufacture Horlogère Suisse discloses a timepiece regulating mechanism which comprises, mounted to move in at least a pivoting motion with respect to a plate, an escape wheel arranged to receive a drive torque via a gear train, and a first oscillator comprising a first rigid structure connected to said plate by first elastic return means. This regulating mechanism includes a second oscillator comprising a second rigid structure, connected to said first rigid structure by second elastic return means, and which includes bearing means arranged to cooperate with complementary bearing means comprised in said escape wheel, synchronizing said first oscillator and said second oscillator with said gear train.

European Patent Application No. EP 17183666 by the same Applicant and incorporated herein by reference, discloses a pivot with a large angular stroke. By using an angle between the strips of approximately 25° to 30°, and a crossing point located at approximately 45% of their length, and by offsetting the centre of mass of the resonator with respect to the axis of rotation, it is possible to simultaneously obtain good isochronism and position insensitivity over a large angular stroke (up to 40° or more). In order to maximise the angular stroke while maintaining good out-of-plane stiffness, the strips are made thinner but of greater height. The use of a high aspect ratio value, i.e. the ratio of the height of the strip to its thickness, is theoretically advantageous, but in practice, with large angular amplitudes, inhibition of anticlastic curvature is observed, which impairs the isochronism properties of the resonator.

SUMMARY OF THE INVENTION

The invention proposes to develop a mechanical oscillator with flexure bearings whose angular stroke is compatible with existing escapement mechanisms, and whose flexure bearings behave in a regular manner regardless of any deformation.

This resonator with a rotational flexure bearing must have the following properties:

high quality factor;

large angular stroke;

good isochronism;

high position insensitivity in space.

Considering the particular case of a flexure bearing with strips crossed in projection in a plane parallel to the oscillation plane, wherein said strips join a stationary mass and a moving mass, the possible angular stroke θ of the pivot depends on the relation X=D/L between, on the one hand the distance D from the embedding point of a strip in the stationary mass and the crossing point, and on the other hand, the total length L of the same strip, in its elongation, between its two opposite embedding points. The aforementioned work of the team of M. H. Kahrobaiyan shows that this possible angular stroke θ, for a given pair of strips with a given vertex angle α at the crossing point, which is 90° here, is maximal where X=D/L=0.5, and decreases rapidly away from this value, in a substantially symmetrical curve. However, such a cross-strip pivot where X=D/L=0.5 and α=90° is not isochronous.

Consequently, the invention explores the ranges of advantageous combinations between the values of vertex angle α at the crossing point of the strips, and the values of ratio X=D/L, in order to obtain isochronous pivots, and optimum values of the aspect ratio of each of the strips.

To this end, the invention concerns a mechanical oscillator according to claim 1.

In particular, the invention shows that an isochronous oscillator can be obtained with pivots which satisfy two inequalities at the same time: $0.15 \leq (X=D/L) \leq 0.85$, et $\alpha \leq 60°$.

Naturally, configurations where α=0° are excluded, since the strips are no longer secant in projection, but parallel to each other.

The invention also concerns a timepiece movement including at least one such mechanical oscillator.

The invention also concerns a watch including such a timepiece movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
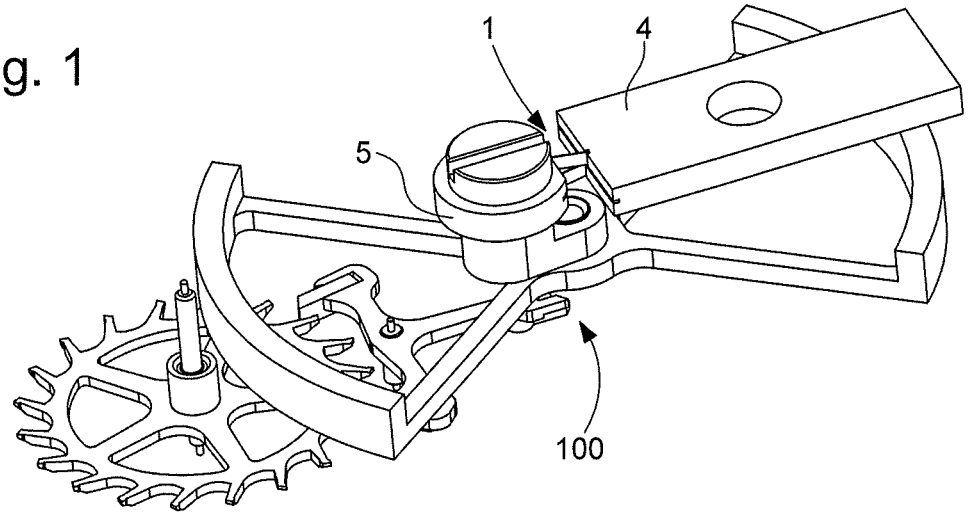
FIG. 1 represents a schematic perspective view of a first variant of a mechanical oscillator, which includes a first rigid support element, of elongated shape, for attachment thereof to a plate of the movement or suchlike, to which is suspended a second solid inertial element by two disjointed flexible strips, crossed in projection onto the oscillation plane of said second inertial element, which cooperates with a conventional Swiss lever escapement with a standard escape wheel.

The invention thus concerns a mechanical timepiece oscillator 100, comprising at least a first rigid support element 4 and a second solid inertial element 5. This oscillator 100 includes, between first rigid support element 4 and second solid inertial element 5, at least two first flexible strips 31, 32, which support second solid inertial element 5, and which are arranged to return it to a rest position. This second solid inertial element 5 is arranged to oscillate angularly in an oscillation plane about said rest position.

The two first flexible strips 31 and 32 do not touch each other, and, in the rest position, their projections onto the oscillation plane intersect at a crossing point P, in immediately proximity to which or through which passes the axis of rotation of second solid inertial element 5 perpendicularly to the oscillation plane. All the geometric elements described hereinafter should be considered to be in the rest position of the stopped oscillator, unless otherwise stated.

FIGS. 1 to 4 illustrate a first variant with a first rigid support element 4 and a second solid inertial element connected by two first flexible strips 31, 32.

The embedding points of first flexible strips 31, 32 in first rigid support element 4 and second solid inertial element 5 define two strip directions DL1, DL2, which are parallel to the oscillation plane and which form between them, in projection onto the oscillation plane, a vertex angle $\alpha$.

The position of crossing point P is defined by the ratio X=D/L where D is the distance between the projection, onto the oscillation plane, of one of the embedding points of first strips 31, 32 in first rigid support element 4 and crossing point P, and wherein L is the total length of the projection, onto the oscillation plane, of the strip 31, 32 concerned. And the value of ratio D/L is comprised between 0 and 1, and vertex angle $\alpha$ is less than or equal to 70°.

Advantageously, vertex angle $\alpha$ is less than or equal to 60° and at the same time, for each first flexible strip 31, 32, the embedding point ratio D1/L1, D2/L2, is comprised between 0.15 and 0.85 inclusive.

Figure 2:
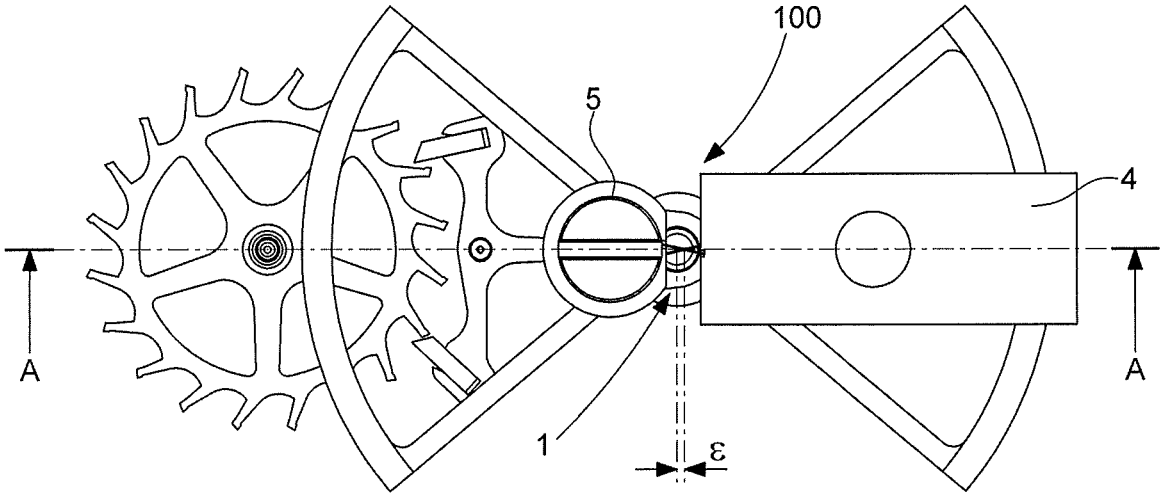
FIG. 2 represents a schematic, perspective view of the oscillator of FIG. 1.
Figure 3:
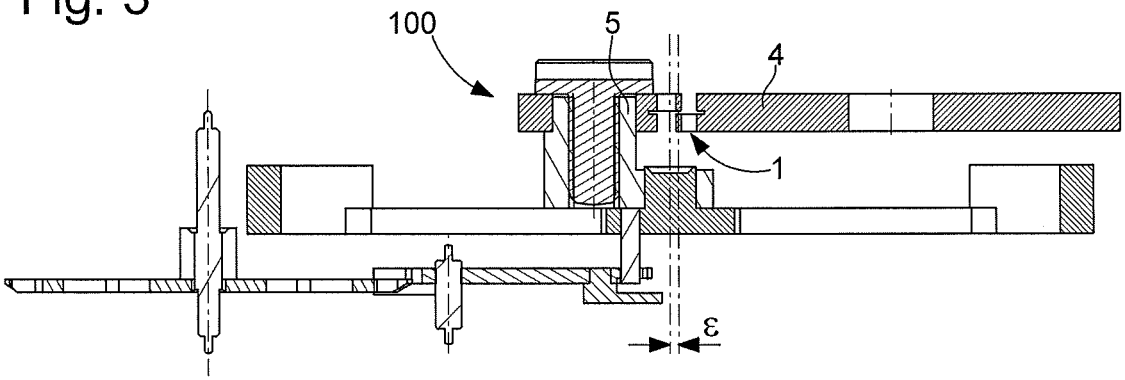
FIG. 3 represents a schematic cross-section through the crossing axis of the strips, of the oscillator of FIG. 1.
Figure 4:
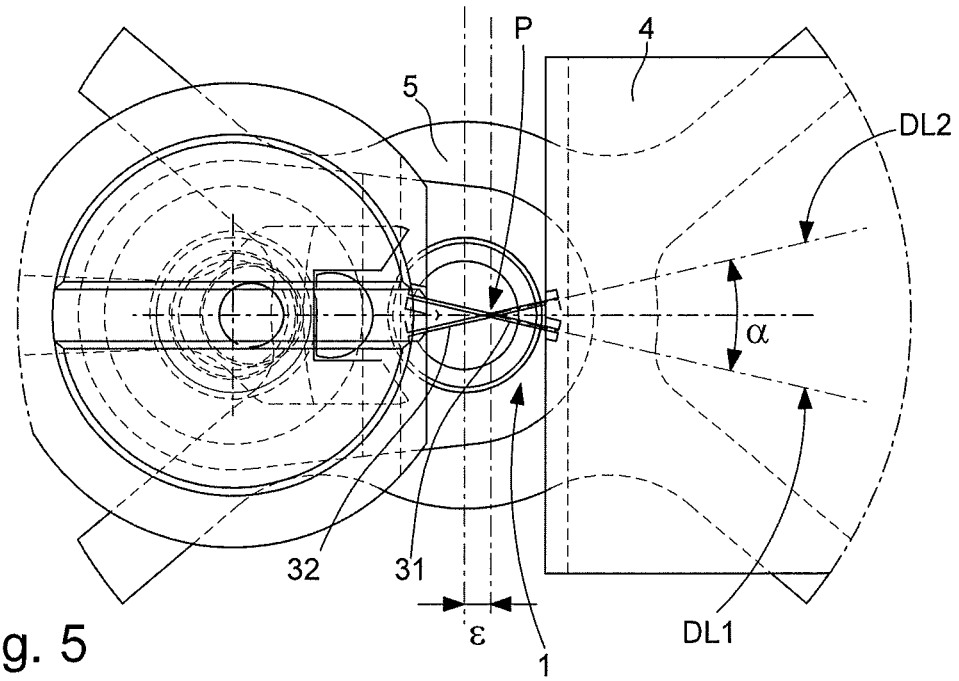
FIG. 4 represents a schematic view of a detail of FIG. 2, showing the offset between the crossing point of the strips and the projection of the centre of mass of the resonator, this detail of the offset being applicable in the same manner to the different variants described hereinafter.

In particular, as seen in FIGS. 2 to 4, the centre of mass of oscillator 100 in its rest position is separated from crossing point P by an offset $\varepsilon$ which is comprised between 10% and 20% of the total length L of the projection, onto the oscillation plane, of strip 31, 32. More particularly still, offsets $\varepsilon$ is comprised between 12% and 18% of the total length L of the projection, onto the oscillation plane, of strip 31, 32.

More particularly, and as illustrated in the Figures, the first strips 31, 32, and their embedding points define together a pivot 1 which, in projection onto the oscillation plane, is symmetrical with respect to an axis of symmetry AA passing through crossing point P.

More particularly, when pivot 1 is symmetrical with respect to axis of symmetry AA, in the rest position, in projection onto the oscillation plane, the centre of mass of second solid inertial element 5 is located on axis of symmetry AA of pivot 1. In projection, this centre of mass may or may not coincide with crossing point P.

More particularly still, the centre of mass of second solid inertial element 5 is located at a non zero distance from crossing point P corresponding to the axis of rotation of second solid inertial element 5, as seen in FIGS. 2 to 4.

In particular, in projection onto the oscillation plane, the centre of mass of second solid inertial element 5 is located on axis of symmetry AA of pivot 1, and is located at a non zero distance from crossing point P which is comprised between 0.1 times and 0.2 times the total length L of the projection onto the oscillation plane of strip 31, 32.

More particularly, the first strips 31 and 32 are straight strips.

More particularly still, vertex angle $\alpha$ is less than or equal to 50°, or is less than or equal to 40°, or less than or equal to 35°, or less than or equal to 30°.

Figure 5:
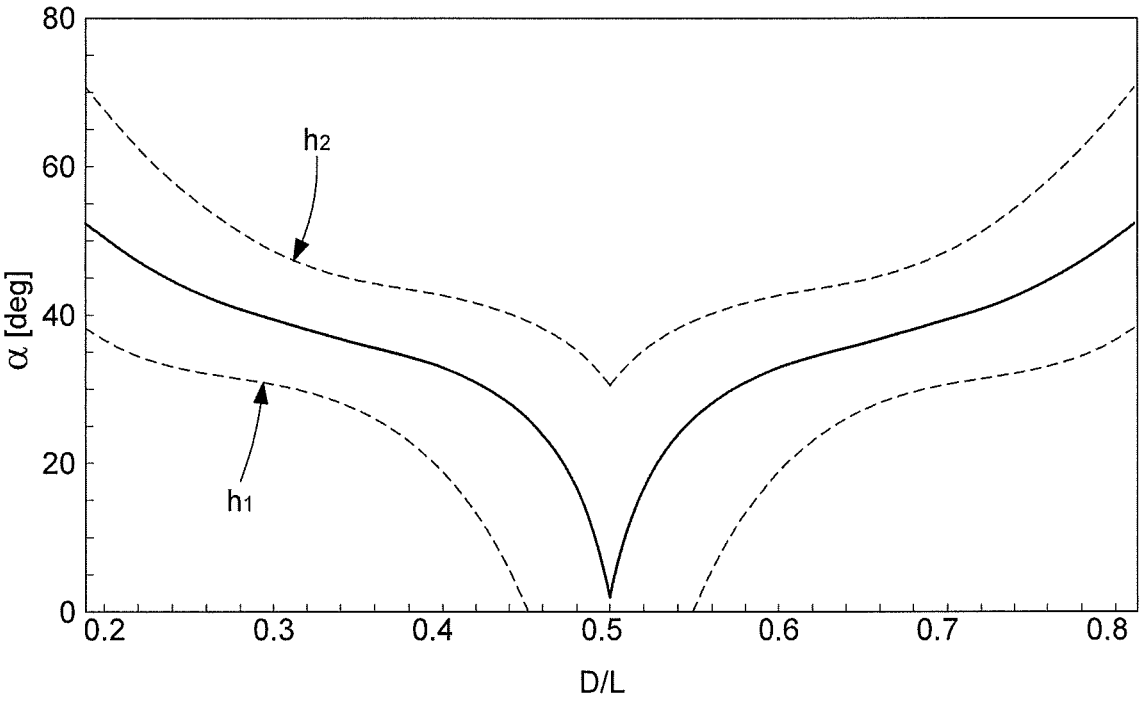
FIG. 5 is a graph with, on the abscissa, ratio X=D/L between, on the one hand, the distance D from the embedding point of a strip in the stationary mass and the crossing point, and on the other hand, the total length L of the same strip between its two opposite embedding points, and on the ordinate, the vertex angle of the crossing point of the flexible strips, and which defines two upper and lower curves, in a dash line, which bound the acceptable domain between these parameters to ensure isochronism. The solid line curve shows an advantageous value.
Figure 9:
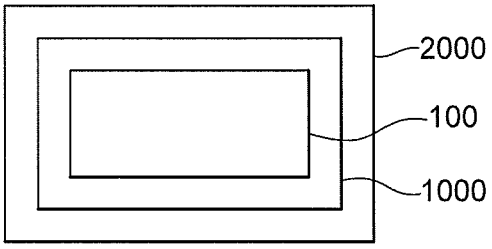
FIG. 9 is a block diagram representing a watch which includes a movement with such a resonator.

More particularly, the embedding point ratio D1/L1, D2/L2, is comprised between 0.15 and 0.49 inclusive, or between 0.51 and 0.85 inclusive, as seen in FIG. 5.

In a variant, and more particularly according to the embodiment of FIG. 5, vertex angle $\alpha$ is less than or equal to 50°, and embedding point ratio D1/L1, D2/L2, is comprised between 0.25 and 0.75 inclusive.

In a variant, and more particularly according to the embodiment of FIG. 5, vertex angle α is less than or equal to 40°, and embedding point ratio D1/L1, D2/L2, is comprised between 0.30 and 0.70 inclusive.

In a variant, and more particularly according to the embodiment of FIG. 5, vertex angle α is less than or equal to 35°, and embedding point ratio D1/L1, D2/L2, is comprised between 0.40 and 0.60 inclusive.

Advantageously, and as seen in FIG. 5, vertex angle α and ratio X=D/L satisfy the relation:

h1(D/L)<α<h2(D/L), where, for 0.2≤X<0.5:

$$h1(X)=116-473*(X+0.05)+3962*(X+0.05)^3-6000*(X+0.05)^4,$$

$$h2(X)=128-473*(X-0.05)+3962*(X-0.05)^3-6000*(X-0.05)^4,$$

for 0.5<X≤0.8:

$$h1(X)=116-473*(1.05-X)+3962*(1.05-X)^3-6000*(1.05-X)^4,$$

$$h2(X)=128-473*(0.95-X)+3962*(0.95-X)^3-6000*(0.95-X)^4.$$

More particularly, and especially in the non-limiting embodiment illustrated by the Figures, first flexible strips 31 and 32 have the same length L, and the same distance D.

More particularly, between their embedding points, these first flexible strips 31 and 32 are identical.

Figure 6:
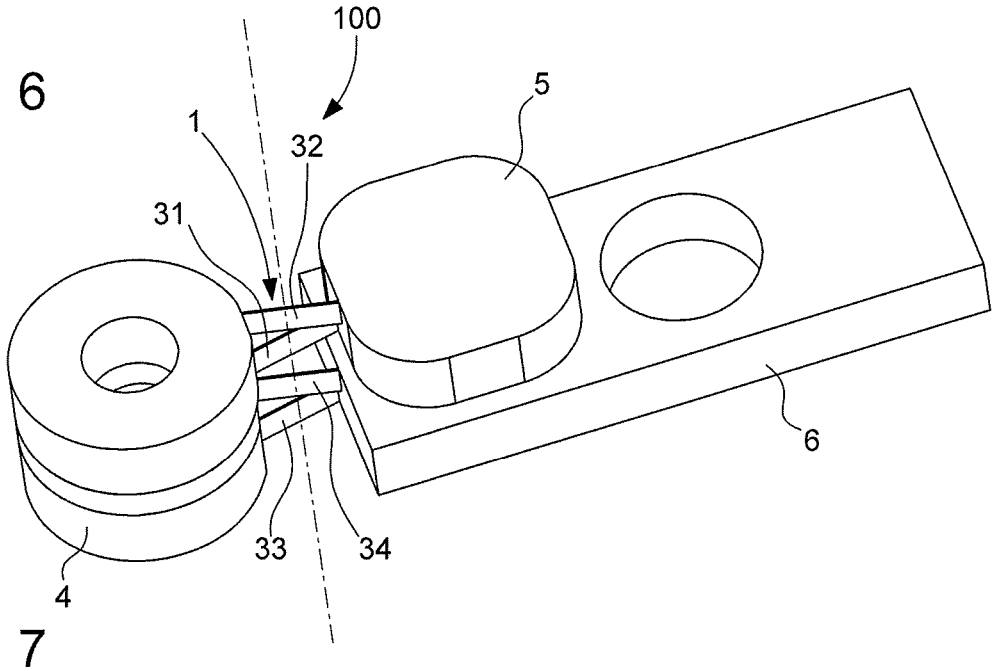
FIG. 6 represents, in a similar manner to FIG. 1, a second variant of the mechanical oscillator, wherein the first rigid support element, of elongated shape, is also movable relative to a stationary structure, and is carried by a third rigid element, by means of a second set of flexible strips, arranged in a similar manner to the first flexible strips, with the second inertial element also being arranged to cooperate with a conventional escapement mechanism (not represented).
Figure 7:
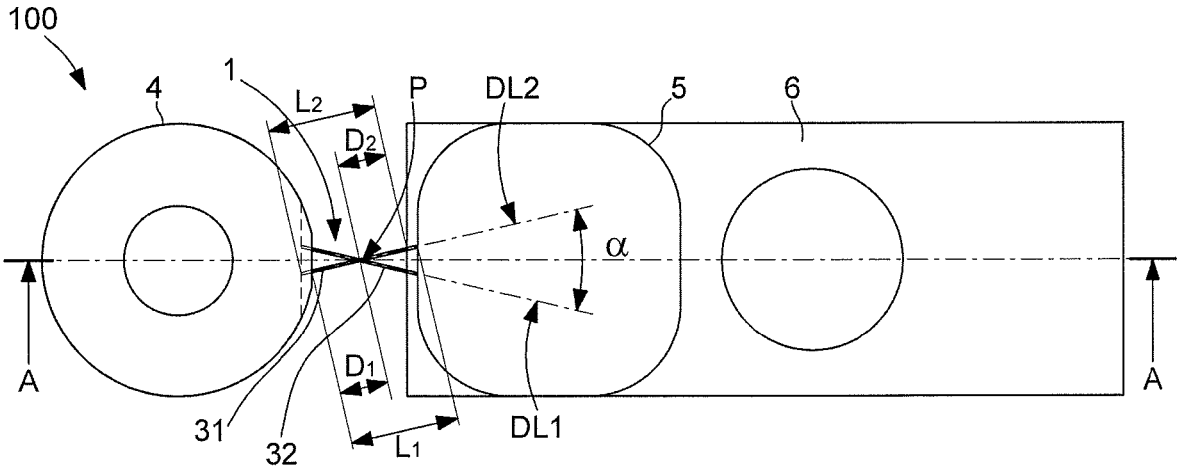
FIG. 7 represents a schematic, plan view of the oscillator of FIG. 6.
Figure 8:
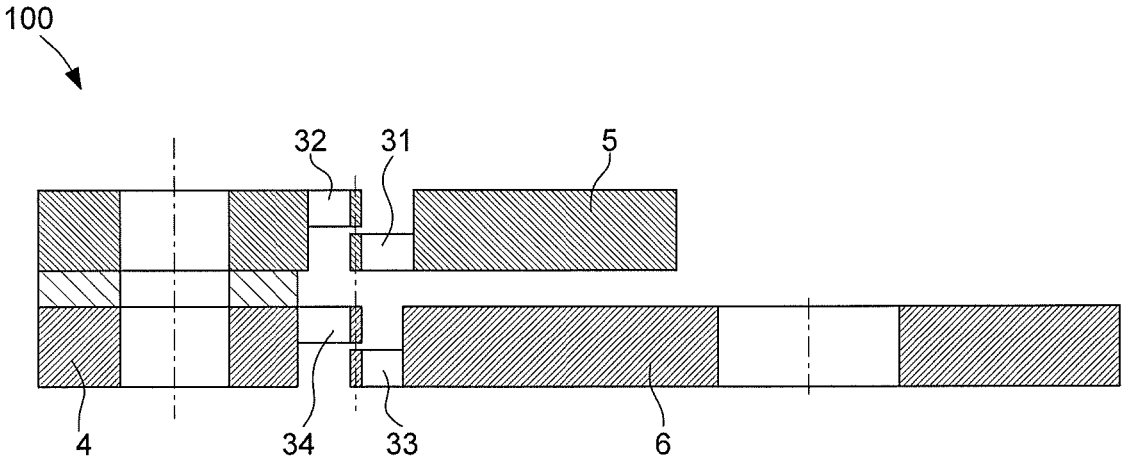
FIG. 8 represents a schematic cross-section through the crossing axis of the strips, of the oscillator of FIG. 1.
Figure 10:
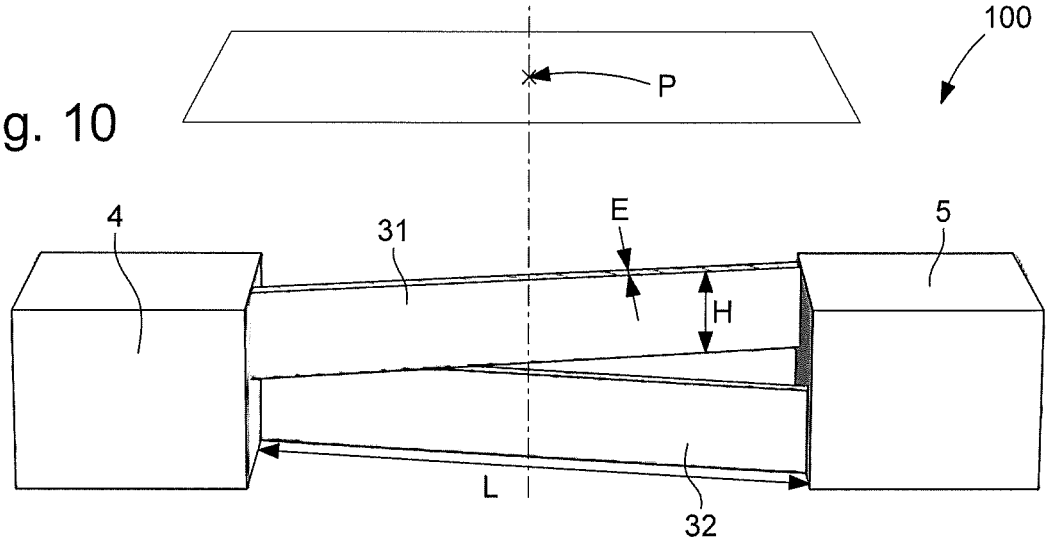
FIG. 10 represents, in a schematic, perspective manner, a bearing with flexible strips crossed in projection, between a stationary structure and an inertial element.
Figure 11:
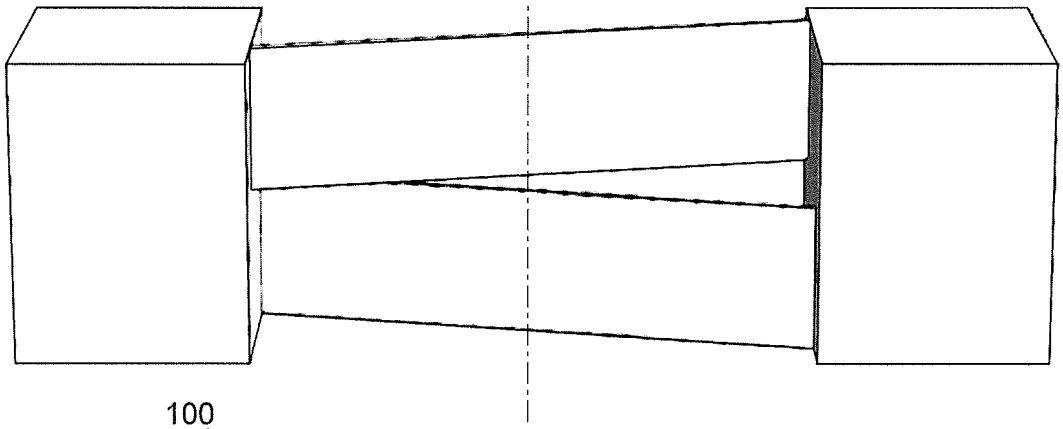
FIG. 11 represents, in a similar manner to FIG. 10, a theoretical flexure bearing wherein each strip has a higher aspect ratio than that of the strips of FIG. 10.

FIGS. 6 to 8 illustrate a second variant of mechanical oscillator 100, wherein first rigid support element 4 is also directly or indirectly movable with respect to a stationary structure comprised in oscillator 100, and is carried by a third rigid element 6, by means of two second flexible strips 33, 34, arranged in a similar manner to first flexible strips 31, 32.

More particularly, in the non-limiting embodiment illustrated by the Figures, the projections of first flexible strips 31, 32 and second flexible strips 33, 34 onto the oscillation plane intersect at the same crossing point P.

In another particular embodiment (not represented), in the rest position, in projection onto the oscillation plane, the projections of first flexible strips 31, 32, and of second flexible strips 33, 34, onto the oscillation plane intersect at two distinct points both located on axis of symmetry AA of pivot 1, when pivot 1 is symmetrical with respect to axis of symmetry AA.

More particularly, the embedding points of second flexible strips 33, 34 with first rigid support element 4 and third rigid element 6 define two strip directions that are parallel to the oscillation plane and form between them, in projection onto the oscillation plane, a vertex angle with the same bisector as vertex angle α between first flexible strips 31, 32. More particularly still, these two directions of second flexible strips 33, 34 have the same vertex angle α as first flexible strips 31, 32.

More particularly, second flexible strips 33, 34 are identical to first flexible strips 31, 32, as in the non limiting example of the Figures.

More particularly, when pivot 1 is symmetrical with respect to axis of symmetry AA, in the rest position, in projection onto the oscillation plane, the centre of mass of second solid inertial element 5 is located on axis of symmetry AA of pivot 1.

Similarly, and particularly, when pivot 1 is symmetrical with respect to axis of symmetry AA, in the rest position, the centre of mass of first rigid support element 4 is located, in projection onto the oscillation plane, on axis of symmetry AA of pivot 1.

In a particular variant, when pivot 1 is symmetrical with respect to axis of symmetry AA, in the rest position, in projection onto the oscillation plane, both the centre of mass of the second solid inertial element 5 and the centre of mass of first rigid support element 4 are located on axis of symmetry AA of pivot 1. More particularly still, the projections of the centre of mass of second solid inertial element 5 and of the centre of mass of first rigid support element 4, on axis of symmetry AA of pivot 1, are coincident.

A particular configuration illustrated by the Figures for such superposed pivots is that wherein the projections of first flexible strips 31, 32 and of second flexible strips 33, 34 onto the oscillation plane intersect at the same crossing point P, which also corresponds to the projection of the centre of mass of second solid inertial element 5, or at least is as close as possible thereto. More particularly, this same point also corresponds to the projection of the centre of mass of first rigid support element 4. More particularly still, this same point also corresponds to the projection of the centre of mass of the entire oscillator 100.

In a particular variant of this superposed pivot configuration, when pivot 1 is symmetrical with respect to axis of symmetry AA, in the rest position, in projection onto the oscillation plane, the centre of mass of second solid inertial element 5 is located on axis of symmetry AA of pivot 1 and at a non-zero distance from the crossing point corresponding to the axis of rotation of second solid inertial element 5, which non-zero distance is comprised between 0.1 times and 0.2 times the total length L of the projection, onto the plane of oscillation, of strip 33, 34, with an offset similar to offset ε of FIGS. 2 to 4.

Similarly and in particular, when pivot 1 is symmetrical with respect to axis of symmetry AA, the centre of mass of second solid inertial element 5 is located, in projection onto the oscillation plane, on axis of symmetry AA of pivot 1 and at a non-zero distance from the crossing point corresponding to the axis of rotation of rigid support element 4, which non-zero distance is comprised between 0.1 times and 0.2 times the total length L of the projection, onto the plane of oscillation, of strip 31, 32.

Similarly and particularly, when pivot 1 is symmetrical with respect to axis of symmetry AA, the centre of mass of first rigid support element 4 is located, in projection onto the oscillation plane, on axis of symmetry AA of pivot 1 and at a non zero distance from the crossing point P corresponding to the axis of rotation of second solid inertial element 5. In particular, this non-zero distance is comprised between 0.1 times and 0.2 times the total length L of the projection, onto the oscillation plane, of strip 33, 34.

Similarly, and particularly when pivot 1 is symmetrical with respect to axis of symmetry AA, the centre of mass of first rigid support element 4 is located, in projection onto the oscillation plane, on axis of symmetry AA of pivot 1 and at a non-zero distance from the crossing point corresponding to the axis of rotation of first rigid support element 4, which non-zero distance is comprised between 0.1 times and 0.2 times the total length L of the projection, onto the oscillation plane, of strip 31, 32.

Similarly, and particularly, the centre of mass of first rigid support element 4 is located on axis of symmetry AA of pivot 1 and at a non zero distance from crossing point P which is comprised between 0.1 times and 0.2 times the total length L of the projection onto the oscillation plane of strip 33, 34.

More particularly, and as seen in the variant of the Figures, when pivot 1 is symmetrical with respect to axis of symmetry AA, in projection onto the oscillation plane, the centre of mass of oscillator 100 in its rest position is located on axis of symmetry AA.

More particularly, second solid inertial element 5 is elongated in the direction of axis of symmetry AA of pivot 1, when pivot 1 is symmetrical with respect to axis of symmetry AA. This is, for example, the case of FIGS. 1 to 4, where inertial element 5 includes a base on which is secured a conventional balance with long arms provided with rim sections or inertia blocks in an arc. The objective is to minimise the effect of external angular accelerations about the axis of symmetry of the pivot, since the strips have low rotational stiffness about this axis because of small angle $\alpha$.

The invention is well suited to a monolithic embodiment of the strips and the solid components that they join, made of micromachinable or at least partially amorphous material, by means of a MEMS or LIGA or similar process. In particular, in the case of a silicon embodiment, oscillator 100 is advantageously temperature compensated by the addition of silicon dioxide to the flexible silicon strips. In a variant, the strips can be assembled, for example, embedded in grooves, or the like.

When there are two pivots in series, as in the case of FIGS. 6 to 9, the centre of mass can be placed on the axis of rotation, in the case where the arrangement is chosen so that undesired movements offset each other, which constitutes an advantageous but non-limiting variant. It should, however, be noted that it is not necessary to choose such an arrangement, and such an oscillator functions with two pivots in series without having to position the centre of mass on the axis of rotation. Of course, although the illustrated embodiments correspond to particular geometric alignment or symmetry configurations, it is clear that it is also possible to place one on top of the other two pivots which are different, or which have different crossing points, or non-aligned centres of mass, or to implement a higher number of sets of strips in series, with intermediate masses to further increase the amplitude of the balance.

In the illustrated variants, all the pivoting axes, strip crossing points, and centres of mass are coplanar, which is a particular, advantageous but non-limiting case.

It is understood that the invention makes it possible to obtain a long angular stroke: in any event greater than 30°, it may reach 50° or even 60°, which makes it compatible in combination with all the usual types of mechanical escapement—Swiss lever, detent, coaxial or other.

It is also a matter of determining a practical solution that is equivalent to the theoretical use of a high aspect ratio value of the strips.

To this end, the invention subdivides the strips lengthwise, by replacing a single strip with a plurality of basic strips whose combined behaviour is equivalent, and wherein each of the basic strips has an aspect ratio limited to a threshold value. The aspect ratio of each basic strip is thus decreased compared to a single reference strip, to achieve optimum isochronism and position insensitivity.

Each strip 31, 32 has an aspect ratio RA=H/E, where H is the height of strips 31, 32, perpendicularly both to the oscillation plane and to the elongation of strip 31, 32, along length L, and wherein E is the thickness of the strip 31, 32 in the oscillation plane and perpendicularly to the elongation of strip 31, 32 along length L.

According to the invention, aspect ratio RA=H/E is less than 10 for each strip 31, 32. More specifically this aspect ratio is lower than 8. And the total number of flexible strips 31, 32 is strictly greater than two.

More particularly, oscillator 100 includes a first number N1 of first strips called primary strips 31 extending in a first strip direction DL1, and a second number N2 of first strips called secondary strips 32 extending in a second strip direction DL2, the first number N1 and second number N2 each being higher than or equal to two.

More particularly, the first number N1 is equal to the second number N2.

More particularly still, oscillator 100 includes at least one pair formed of one primary strip 31 extending in a first strip direction DL1, and one secondary strip 32 extending in a second strip direction DL2. And, in each pair, the primary strip 31 is identical to the secondary strip 32 except as regards orientation.

In a particular variant, oscillator 100 only includes pairs each formed of one primary strip 31 extending in a first strip direction DL1, and one secondary strip 32 extending in a second strip direction DL2 and, in each pair, the primary strip 31 is identical to the secondary strip 32, except as regards orientation.

In another variant, oscillator 100 includes at least one group of strips formed of one primary strip 31 extending in a first strip direction DL1, and a plurality of secondary strips 32 extending in a second strip direction DL2. And, in each case, in each group of strips, the elastic behaviour of primary strip 31 is identical to the elastic behaviour resulting from the combination of the plurality of secondary strips 32, except as regards orientation.

It is also noted that, although the behaviour of one flexible strip depends on its aspect ratio RA, it also depends on the value of the curvature imparted thereto. Its deflected curve depends both on the aspect ratio value and the local radius of curvature value, especially at the embedding point. This is the reason why a symmetrical arrangement of the strips in planar projection is preferably adopted.

The invention concerns a timepiece movement 1000 including at least one such mechanical oscillator 100.

The invention also concerns a watch 2000 including at least one such timepiece movement 1000.

Figure 12:
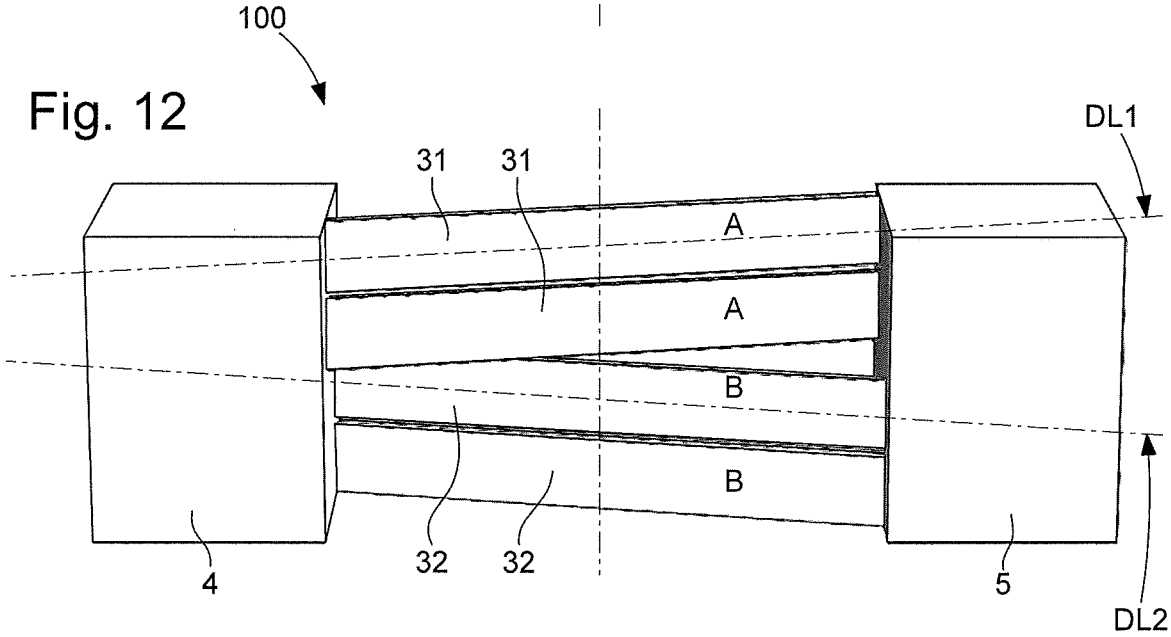
FIG. 12 represents, in a similar manner to FIG. 10, a flexure bearing according to the invention, which is equivalent in terms of elastic return to the theoretical bearing of FIG. 11, but which has a higher number of strips, wherein each has an aspect ratio lower than 10. In this variant, two basic strips of a first type are superposed in a first direction, and cross in projection two basic strips of a second type which are also superposed and extend in a second direction.

A suitable fabrication method consists in performing, for the various types of pivots below, the following operations:

Pour un type de pivot AABB selon le schèma de la FIG. 12:

a. using a substrate with at least four layers, resulting, for example but not exclusively from the assembly of two SOI wafers;
b. front side etching, by a DRIE process, to obtain AA, especially etching two layers in one piece;
c. back side etching, by a DRIE process, to obtain BB, especially etching two layers in one piece;
d. partially separating the four layers by etching the buried oxide.

The high precision of the DRIE (deep reactive ion etching) process ensures very high positioning and alignment precision, less than or equal to 5 micrometres, owing to an optical alignment system, which ensures very good side-to-side alignment. Naturally, similar processes can be implemented, depending on the material chosen.

It is possible to implement substrates with a larger number of layers, particularly a substrate with six available layers, for example, by assembling two DSOI, to obtain an AAABBB type structure.

A variant for obtaining a same AABB type pivot consists in:

a. using two standard SOI substrates with two layers;

b. DRIE etching the first substrate, on the front side to obtain A, on the back side to obtain A;

c. DRIE etching the second substrate, on the front side to obtain B, on the back side to obtain B; as an alternative to operations b and c, it is possible to etch through the two layers in one step on the first substrate and on the second substrate, without performing a front side and back side etch.

d. performing the wafer-to-wafer bonding of two substrates or part-to-part assembly of the individual components, to obtain AABB. Correct alignment of the geometries is then linked to the specification of the wafer-to-wafer bonding machine or to the part-to-part process, in a manner well known to those skilled in the art.

Figure 13:
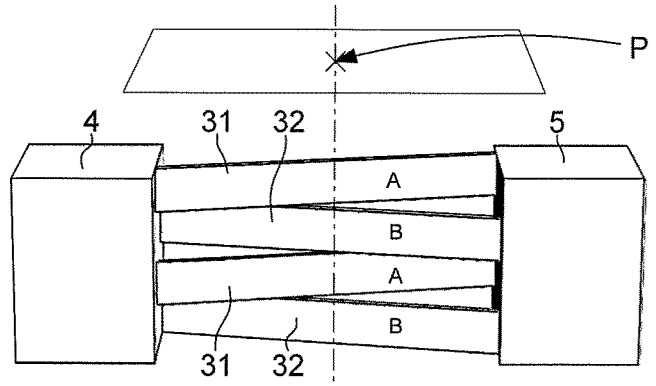
FIG. 13 represents, in a similar manner to FIG. 12, another flexure bearing according to the invention in which the four strips are arranged alternately.
Figure 14:
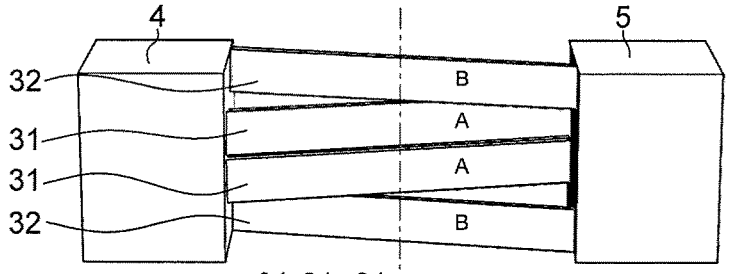
FIG. 14 represents, in a similar manner to FIG. 12, yet another flexure bearing according to the invention, in which the four strips include two basic strips of a first type in a first direction, which flank two basic strips of a second type which are superposed and extend in a second direction.
Figure 15:
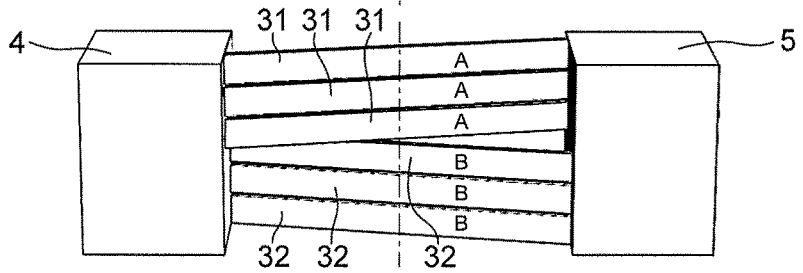
FIG. 15 represents, in a similar manner to FIG. 12, another flexure bearing according to the invention including six strips superposed in threes.
Figure 16:
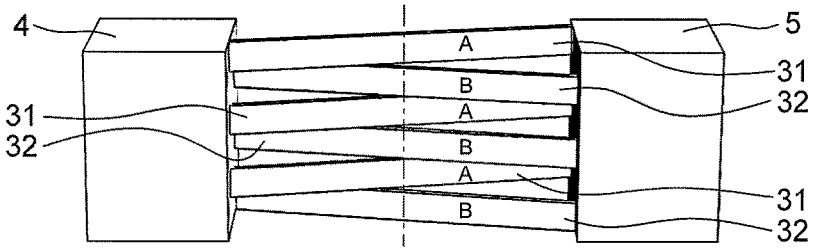
FIG. 16 represents, in a similar manner to FIG. 13, another flexure bearing according to the invention, in which the six strips are arranged alternately.
Figure 17:
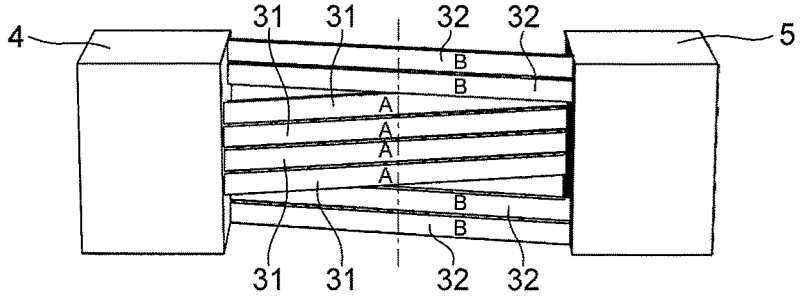
FIG. 17 represents, in a similar manner to FIG. 14, another flexure bearing according to the invention, in which the eight strips include a first and a second superposition of two basic strips of a first type in a first direction, which flank four basic strips of a second type which are superposed and extend in a second direction.
Figure 18:
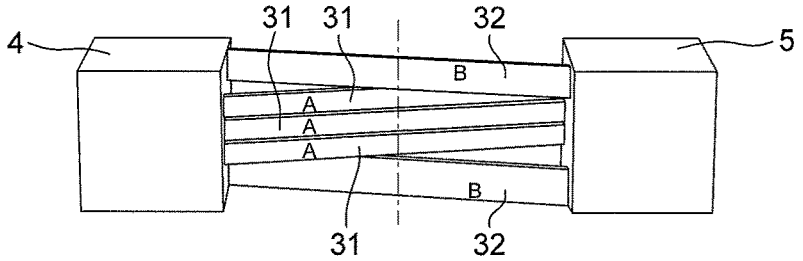
FIG. 18 represents, in a similar manner to FIG. 12, yet another flexure bearing according to the invention, with an odd number of strips, in which the five strips include two basic strips of a first type in a first direction, which flank three basic strips of a second type which are superposed and extend in a second direction.

For an ABAB type pivot according to the diagram of FIG. 13:

a. using two standard SOI substrates with two layers;

b. DRIE etching the first substrate, on the front side to obtain A, on the back side to obtain B;

b. DRIE etching the second substrate, on the front side to obtain A, on the back side to obtain B;

d. performing the wafer-to-wafer bonding of two substrates or part-to-part assembly of the individual components, to obtain ABAB. As above, correct alignment of the geometries is then linked to the specification of the wafer-to-wafer bonding machine or to the part-to-part process.

Many other variants of the method can be implemented, depending on the number of strips and available equipment.

The invention claimed is:

1. A mechanical timepiece oscillator comprising:

a flexure bearing disposed between a first rigid support element and a solid inertial element and including more than two first flexible strips which support said solid inertial element and are arranged to return said solid inertial element to a rest position, wherein said solid inertial element is arranged to oscillate angularly in an oscillation plane about said rest position, said more than two first flexible strips do not touch each other and their projections onto said oscillation plane cross, in the rest position, at a crossing point, in proximity to which or through which passes an axis of rotation of said solid inertial element perpendicularly to said oscillation plane, and embedding points of said more than two first flexible strips in said first rigid support element and said solid inertial element define two strip directions parallel to said oscillation plane, each strip of the more than two first flexible strips has an aspect ratio RA=H/E, where H is a height of said strip perpendicularly both to the oscillation plane and to an elongation of said strip along a length L, and wherein E is a thickness of said strip in the oscillation plane and perpendicularly to the elongation of said strip along said length L, wherein said aspect ratio RA=H/E is less than 10 for each said strip.

2. The mechanical oscillator according to claim 1, wherein said oscillator includes a first number N1 of said more than two first flexible strips as primary strips extending in a first strip direction, and a second number N2 of said more than two first flexible strips as secondary strips extending in a second strip direction, said first number N1 and said second number N2 each being greater than or equal to two.

3. The mechanical oscillator according to claim 2, wherein said first number N1 is equal to said second number N2.

4. The mechanical oscillator according to claim 2, wherein said oscillator includes at least one pair formed of said primary strip extending in a first strip direction, and said secondary strip extending in a second strip direction and wherein, in each pair, said primary strip is identical to said secondary strip except as regards orientation.

5. The mechanical oscillator according to claim 4, wherein said oscillator includes only said pairs each formed of said primary strip extending in a first strip direction, and said secondary strip extending in a second strip direction, and wherein, in each pair, said primary strip is identical to said secondary strip, except as regards orientation.

6. The mechanical oscillator according to claim 2, wherein said oscillator includes at least one group of strips formed of said primary strip extending in a first strip direction, and said secondary strip extending in a second strip direction and wherein, in each said group of strips, elastic behavior of said primary strip is identical to the elastic behavior resulting from a plurality of secondary strips including the secondary strip except as regards orientation.

7. The mechanical oscillator according to claim 1, wherein said first strips are straight strips.

8. The mechanical timepiece oscillator according to claim 1, wherein said two strip directions parallel to said oscillation plane form therebetween, in the rest position, in projection onto said oscillation plane, a vertex angle $\alpha$, the position of said crossing point being defined by a ratio X=D/L, where D is a distance between the projection, onto said oscillation plane, of one of the embedding points of said first strips in said first rigid support element and said crossing point, and L is a total length of the projection, onto said oscillation plane, of said strip in its elongation, and wherein an embedding point ratio is comprised between 0.15 and 0.49 inclusive, or between 0.51 and 0.85 inclusive.

9. The mechanical oscillator according to claim 8, wherein said vertex angle is less than or equal to 50°, and wherein said embedding point ratio is comprised between 0.25 and 0.75 inclusive.

10. The mechanical oscillator according to claim 9, wherein said vertex angle is less than or equal to 40°, and wherein said embedding point ratio is comprised between 0.30 and 0.70 inclusive.

11. The mechanical oscillator according to claim 10, wherein said vertex angle is less than or equal to 35°, and wherein said embedding point ratio is comprised between 0.40 and 0.60 inclusive.

12. The mechanical oscillator according to claim 8, wherein said vertex angle is less than or equal to 30°.

13. The mechanical oscillator according to claim 1, wherein an apex angle and a ratio X=D/L satisfy a relation $h1(D/L)<\alpha<h2(D/L)$, where, for $0.2\leq X<0.5$:

$$h1(X)=116-473*(X+0.05)+3962*(X+0.05)^3-6000*(X+0.05)^4,$$

$$h2(X)=128-473*(X-0.05)+3962*(X-0.05)^3-6000*(X-0.05)^4,$$

for $0.5<X\leq 0.8$:

$$h1(X)=116-473*(1.05-X)+3962*(1.05-X)^3-6000*(1.05-X)^4,$$

$$h2(X)=128-473*(0.95-X)+3962*(0.95-X)^3-6000*(0.95-X)^4.$$

14. The mechanical oscillator according to claim 1, wherein a center of mass of said oscillator in its rest position is separated from said crossing point by an interval which is comprised between 10% and 20% of a total length of the projection, onto said oscillation plane, of said strip.

15. The mechanical oscillator according to claim 14, wherein said interval is comprised between 12% and 18% of a total length of the projection, onto said oscillation plane, of said strip.

16. The mechanical oscillator according to claim 1, wherein said first strips and their embedding points define together a pivot which, in projection onto said oscillation plane, is symmetrical with respect to an axis of symmetry passing through said crossing point.

17. The mechanical oscillator according to claim 16, wherein, in the rest position, in projection onto said oscillation plane, a center of mass of said solid inertial element is located on said axis of symmetry of said pivot.

18. The mechanical oscillator according to claim 17, wherein, in projection onto said oscillation plane, a center of mass of said solid inertial element is at a non zero distance from said crossing point corresponding to an axis of rotation of said solid inertial element, which non zero distance is comprised between 0.1 times and 0.2 times a total length of the projection, onto said oscillation plane, of said strip.

19. A timepiece movement comprising the mechanical oscillator according to claim 1.

20. A watch comprising the timepiece movement according to claim 19.

* * * * *